United States Patent [19]

Luerken et al.

[11] Patent Number: 4,595,148

[45] Date of Patent: Jun. 17, 1986

[54] MACHINE FOR COMMINUTING WASTE MATERIAL

[75] Inventors: Adolf Luerken, Palos Verdes; Edward J. Pilatowicz, Los Angeles, both of Calif.

[73] Assignee: McCulloch Corporation, Los Angeles, Calif.

[21] Appl. No.: 538,516

[22] Filed: Oct. 3, 1983

[51] Int. Cl.[4] ..... B02C 18/12

[52] U.S. Cl. ..... 241/92; 241/101 D; 241/101.7

[58] Field of Search ..... 241/101.7, 92, 101 D, 241/55, 56, 152 R, 224, 225, 101.6, 46.17, 282.2

[56] References Cited

U.S. PATENT DOCUMENTS

| | | | |
|---|---|---|---|
| 2,278,125 | 3/1942 | Landgrae | 241/282.2 |
| 2,949,246 | 8/1960 | Hyde | 241/46.17 X |
| 3,240,247 | 3/1966 | Lautzenheiser | 241/101.7 |
| 3,412,770 | 11/1968 | Johnson | 241/101.7 X |
| 4,218,022 | 8/1980 | Boehm et al. | 241/101.7 |
| 4,360,166 | 11/1982 | Biersack | 241/101.7 X |

FOREIGN PATENT DOCUMENTS

| | | |
|---|---|---|
| 1944559 | 3/1971 | Fed. Rep. of Germany . |
| 725839 | 3/1966 | United Kingdom . |
| 1303406 | 1/1973 | United Kingdom . |

OTHER PUBLICATIONS

"Shred All", Honko Mfg. Co., Ltd., 9-1983.

"Roto-Hoe, Cut 'n Shred Shredder", 9-1983.

Lindsley, Chippers and Shredders Cut Your Junk Yard Down To Size, Popular Science, Nov. 1973, pp. 116-119.

*Primary Examiner*—Mark Rosenbaum

*Attorney, Agent, or Firm*—Murray and Whisenhunt

[57] ABSTRACT

A comminuting apparatus for garden waste consists of a cutter support plate rotating about a vertical axis in a cutter housing provided with a laterally directed outlet channel. The support plate includes cutting slots and slicing cutters thereabove. The support plate further includes at least one dependent discharge blade located on the underside thereof. At least one spiral deflecting vane is mounted on the cutter housing beneath the support plate. Upon rotation of the cutter support, the cutting slots and slicing cutters cooperate to direct comminuted material downwardly through the support plate, while the dependent discharge blade and the spiral deflecting vane cooperate to force comminuted material out through the laterally directed outlet channel.

26 Claims, 12 Drawing Figures

A-A

MACHINE FOR COMMINUTING WASTE MATERIAL

BACKGROUND OF THE INVENTION

1. Field of the Invention

This invention relates to a machine for comminuting waste material. In a particular embodiment it relates to a shredder-mulcher for comminuting garden waste material.

2. Description of the Prior Art

The comminuation of materials for industrial use or for the disposal of wastes has for many years presented a technological challenge, with respect to both efficient use of available motor power and production of a desired end product.

Hagerty, U.S. Pat. No. 332,796, discloses a bark cutting machine comprising a disc, which can rotate about a vertical axis, having non-radial slots through which cutting blades extend upwardly. A cover fits closely over the disc and blade assembly and the cover is fitted with a plurality of narrow openings over which are fitted narrow hoppers so that tree bark can be fitted edge-wise to the cutters. The hopper sides slope downwardly in the direction of rotation of the blades so that bark will be caught between the blades and the hopper sides and not rise out of place.

Everett, U.S. Pat. No. 2,181,397, discloses a dual purpose feed mill for cutting and grinding corn stalks. The feed mill contains an ensilage cutter, blades mounted on a disc rotating about a horizontal axis for cutting corn stalkes into short length, and a grinder, flails mounted on a common axis with the disc for grinding cut corn stalks, in a common housing but separated by an annular ring. The annular ring contains a valve means whereby cut corn stalks from the ensilage cutter can be fed to the grinder.

Dunbar, U.S. Pat. No. 2,566,721, discloses a rotary disc chipper having a cover plate provided with at least one rectangular feed opening; a pulp-receiving shoe having an inclined passage communicating with the feed opening; a horizontal rotor below the cover plate; and a plurality of straight-edged chipper knives mounted on said rotor adapted to sweep across the rectangular feed opening, each knife being located with reference to a quadrant so as to be substantially perpendicular to the leading radius of the quadrant and substantially parallel to the trailing radius of the quadrant, each knife being of a length sufficient to completely traverse the feed opening and securely hold a piece of wood being cut in an angle of the rectangular opening and in the pulp-receiving shoe. Preferably, the number of knives on the rotor is one less or more than the number of openings so that the several knives will be at different points of engagement with the pulp logs in the shoes and the torque upon the shaft incidental to cutting the logs will be substantially constant.

Shively, U.S. Pat. No. 2,665,852, discloses an ice chipping machine comprising a working chamber including a hopper adapted to contain ice; a rotary plate in the chamber, having a plurality of openings and a plurality of picks adjacent the openings, the picks being adapted to form chips from said ice and to deflect the chips through the openings. A central breaker comprising a hub equipped with outwardly extending hooked picks is secured centrally on top of the rotary plate. Chipped ice which falls through the rotary plate is discharged through a discharge outlet by a centrifugal ejector.

Wexell, U.S. Pat. No. 3,069,101, discloses a wood chipper comprising a chipper disc mounted for rotation on a horizontal axis; a housing surrounding the disc, the housing having an outlet for chipped material; a first feed spout disposed horizontally and communicating with said housing; and a second feed spout inclining downwardly toward the housing and communicating with the housing at a level above and at substantially the same radius with respect to the disc as the first spout.

Prohl, U.S. Pat. No. 3,448,932, discloses a waste disposal device for a variety of fruit and vegetable waste materials. The device includes a frame providing a support for a housing containing a cutting/grinding chamber; a hopper located above the chamber for receiving waste material to be fed to the chamber; a rotary cutter assembly mounted in the chamber on a shaft driven by a motor, the rotary cutter assembly having a feed plate with mulching knives mounted thereon; a stationary cutter bar assembly is mounted on the wall of the chamber and includes a blade or anvil which cooperates with a feed knife mounted on top of the rotary cutter assembly, the feed knife partially overlying a feed slot formed at the outer margin of the cutter assembly.

Salzmann, Jr., U.S. Pat. No. 3,559,705, discloses a reversible, symmetrical knife for a drum-type wood chipper.

Hamlin, U.S. Pat. No. 3,817,462, discloses a shredder comprising a chute for supplying the material to the shredding mechanism; a hopper positioned over the chute into which material to be shredded may be placed; an impeller and a rotatable blade mounted on a horizontal shaft; and flails carried by the impeller which drive material through spaced fingers carried on a housing surrounding the blade and impeller.

Smith, U.S. Pat. No. 3,861,602, discloses a brush chipper for reducing material such as limbs, branches, brush and the like to chips wherein a powered feed mechanism moves material in a longitudinal path to a rotary chipping mechanism having a chipping disc rotatable about a substantially horizontal axis. The chipping disc mounts a single, radial, chipping knife which is angularly disposed relative to the feed path to draw the material into the mechanism.

Svensson, U.S. Pat. No. 4,047,670, discloses a rotary cutting apparatus having reversible cutters or knife devices mounted on a rotary disc.

Fudman, U.S. Pat. No. 4,113,190, discloses a device for shaving ice comprising a hopper for holding a supply of ice; an agitator positioned below said hopper to agitate said ice; a comminution system coupled to said agitator containing ice shaving components; and at least one baffle positioned within the hopper and monolithic with said hopper to impede turning of the total ice mass.

Svensson, U.S. Pat. No. 4,155,384, discloses a disc-type wood chipper having cutting knives disposed non-radially on a chipper disc to cut a slab of wood from a log and having guide means with ridges over which the slab is caused to slide so that the slap disintegrates into wood chips of substantially uniform size.

Lapointe, U.S. Pat. No. 4,159,083, discloses a debris separating chipper wherein the housing is divided by a chipping disc into a front chamber and a chip chamber and wherein separate outlets are provided from the front chamber and from the chip chamber, respectively, for twigs and the like and for chips whereby separation of chips from debris is obtained.

Nonetheless, the disposal of waste materials by comminuation continues to represent a major problem. In recent years, with bans on residential brush burning and with many cities reluctant to haul and dump voluminous masses of garden waste, such as leaves, tree prunings, garden stalks and hedge trimmings, an increasing focus on the disposal of garden wastes has occurred. Fortunately, a strong interest in organic gardening has also developed. However, in order to utilize garden waste materials in the efficient production of compost or mulch these materials should be comminuted to reduce bulk and increase surface area for reaction with organisms aiding decomposition. Many attempts have been made to supply apparatus for this purpose.

Lindsley ("Chippers and Shredders Cut Your Junk Yard Down to Size", Popular Science, November 1973, pp. 116–119) gives an overview of various commercially available machines such as shredder-baggers, grinder-composters (Hammermill-type) and chipper-shredders. Shredder-baggers having shaft-mounted rotary blades swinging through breaker plates can only handle leaves and small twigs. Grinder-composters of the Hammermill-type utilize pivoted flails to chop up all garden waste except heavy brush and limbs. Chipper-shredders utilize jointer-like blades mounted on a rotating disc to cut logs up to three inches in diameter, while shredding blades projecting from the periphery of the disc can shred lighter materials and the cut log pieces.

British Pat. No. 725,839 discloses a machine for grinding and/or masticating vegetable materials comprising a container having a top feed opening and a bottom discharge opening, a motor-driven shaft journalled in top and bottom journals supported by the container and a plurality of circumferentially spaced knives on said shaft. Material to be cut is dropped in the top and shredded by said knives and ejected by said knives which also function as impellers. However, such a machine cannot handle logs or heavy branches lest the blades break or the branches become caught in the blades clogging the machine.

German Offenlegungsschrift No. 1,944,559 discloses a shredder for garden debris comprising a disc-like blade holder which rotates on a motor-driven shaft. A plurality of rectangular blades are pivotally mounted on the outer edge portion of the disc by bolts passing through the disc and one end of the rectangular blade. A housing covers the rotating disc and blades, the housing being fitted with a funnel-like opening for material to be shredded, which feeds the material into the path of the rotating blades, and a discharge opening for ejecting shredded debris. However, such an apparatus cannot handle logs or heavy branches.

British Pat. No. 1,303,406 discloses a chipper-shredder comprising a disc-like support plate mounted on a vertical, motor-driven shaft. A chipping blade, with a cutting edge spaced slightly above the disc, is fastened to the top of the disc and extends radially from the shaft. A slot is provided in the disc directly below the cutting edge. Shredding blades are pivotally mounted on pins, extending downward from the disc, around the periphery of the disc. A hopper for the feeding of heavy material to the chipping blade is provided, as well as a hopper for separately feeding light material to the shredding blades. A housing encloses the support plate and associated blades and a tangential discharge opening is provided in the housing. While this machine allows both heavy and light material to be comminuted separately, the radial placement of the chipping blade results in a heavy chopping action which causes excessive wear of bearings supporting the shaft on which the support plate rotates and necessitating a high power, heavy duty motor. Additionally, a spacious blade housing is required to accomodate the shredding blades mounted on the periphery of the support plate. Furthermore, the material shredded can become partly involved in the shredding blades, so that it is only torn into long strips or merely bent about the blade. Such strip-like or bent material tends to catch in the outlet channel and blockages occur necessitating shut-down and cleaning of the machine.

Biersack, U.S. Pat. No. 4,360,166, discloses a motor-driven shredding apparatus for garden waste comprising a cutter housing having a laterally-directed discharge outlet; a cutter support plate mounted within the cutter housing for rotation about a central vertical axis; at least one dependent discharge blade mounted on the lower side of the cutter support plate; at least one radial slot in the cutter support plate with a shredding cutter mounted thereabove; a cylindrical charging container located over the cutter housing, the cutter support plate forming a base for the container, at least one shredding blade mounted centrally on the upper side of the cutter support plate and extending upwardly and outwardly therefrom into the charging container; an inlet for light material at the top of the container; an inlet for heavy material discharging above the cutter support plate; and at least one fixed counter-plate located above the path of rotation of said planar cutting blade and below the path of rotation of said shredding blade. While this patent discloses a compact machine for shredding both heavy and light materials, it utilizes a radially mounted shredding cutter which creates a chopping action. This chopping action places a heavy stress on the shaft supporting the cutter support plate and the bearings supporting that shaft. Moreover, radial positioning and the concommitant chopping action are not very effective in comminuting soft materials such as wet weeds and vines which tend to build up on the blade and may ultimately stop the machine. Comminuted material which falls through the slots can be caught up by the dependent discharge blades and carousel around in the cutter housing beneath the cutter support plate thus blocking discharge of material and ultimately requiring shut-down of the machine for cleaning. The inlet tube for feeding heavy material is set at a rather shallow angle to the cutter support plate and this creates long oval chips which require increased cutting power and further exacerbates the stress due to the chopping action of the shredding cutter. Moreover, this shallow angle also exhibits a tendency to draw parts of the sticks and limbs along the disc travel and never cut them up. The fixed counter plate is angled downwardly so that it forces small twigs and branches onto the cutter plate, however, this tends to cause a build-up of material between the counter-plate and the support plate resulting in a wedge of material acting as a disc brake on the plate and requiring higher motor power. Likewise, twigs fed into the top of the drum are partially broken up and wedged between the inlet tube for heavy material and the support plate resulting in a braking effect. Thus, there is still a need for a machine which does not waste motor power in overcoming unnecessary frictional drag, obtains maximum cutting efficiency and is not subject to clogging.

SUMMARY OF THE INVENTION

The present invention provides a machine for comminuting waste material, particularly garden wastes such as vines, trimmings, limbs and branches, which avoids the aforementioned problems and yet provides a lightweight and portable machine suitable for residential use. In one embodiment the invention provides a machine for comminuting garden waste material comprising:

a cutter housing having a laterally-directed outlet for the discharge from the machine of comminuted material;

a cutter support plate mounted within the cutter housing for rotation about a central substantially vertical axis, said cutter support plate provided with at least one dependent discharge blade located on the lower side of said plate;

at least one non-radial cutting slot in the cutter support plate, a slicing cutter mounted upon the cutter support plate above each non-radial cutting slot and cooperating therewith on rotation of the cutter support plate to slice waste material and direct the comminuted waste material downwardly through the cutter support plate;

a charging container having a substantially vertical axis and walls for receiving waste material to be comminuted located over the cutter housing, the cutter support plate being positioned so as to form a base for the container;

at least one shredding blade mounted on the upper side of the cutter support plate for rotation therewith and extending upwardly and outwardly from said central substantially vertical axis into the charging container;

an inlet for light material to be comminuted located at the top of the container;

an inlet for heavy material to be comminuted comprising a downwardly inclined tube passing through a lower wall of the container to discharge above the cutter support plate in the path of rotation of said at least one slicing cutter; and a fixed counter-plate means, mounted on the wall of said charging container and located substantially diametrically opposite said inlet for heavy material, comprising an upper section sloping downwardly in the direction of rotation of said cutter plate and a lower section of substantially vertical orientation, said counter-plate means positioned so that the path of rotation of each slicing cutter is below and adjacent said counter-plate and so that the path of rotation of each shredding blade is above and adjacent said counter-plate, said counter-plate means cooperating with each shredding blade to produce shear action on waste material therebetween.

DETAILED DESCRIPTION OF THE PREFERRED EMBODIMENTS

Figure 2:
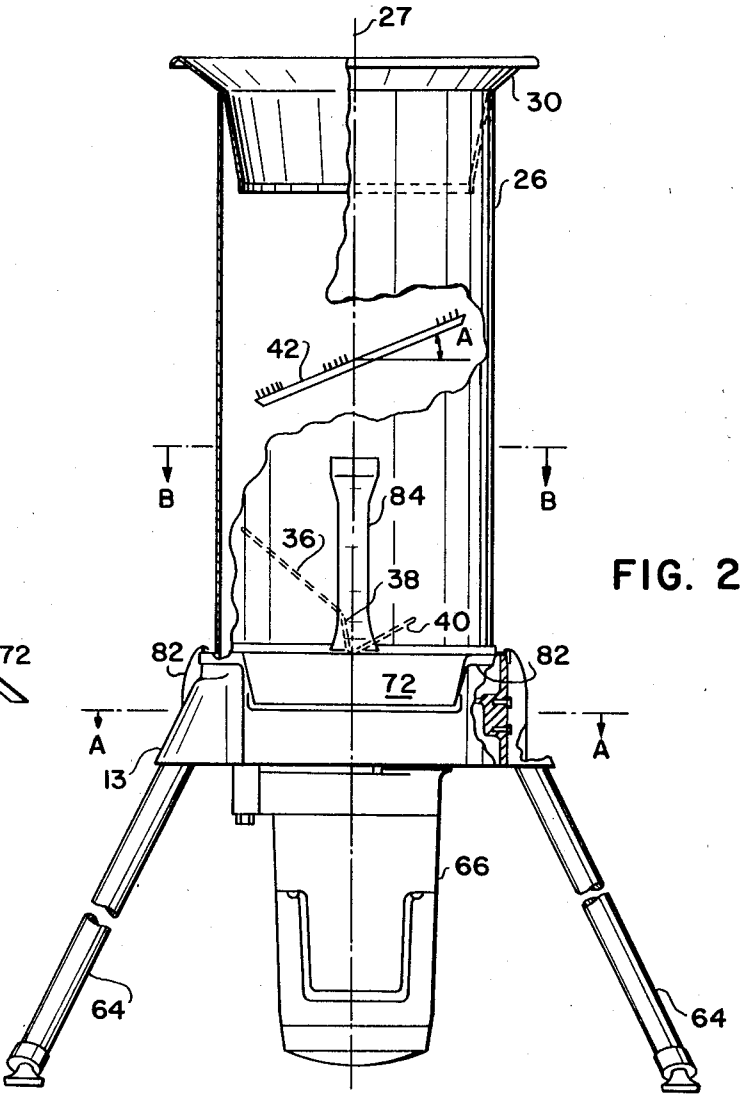
FIG. 2 is an end view of the apparatus illustrated in FIG. 1, also in partial section and partial cut-away.
Figure 1:
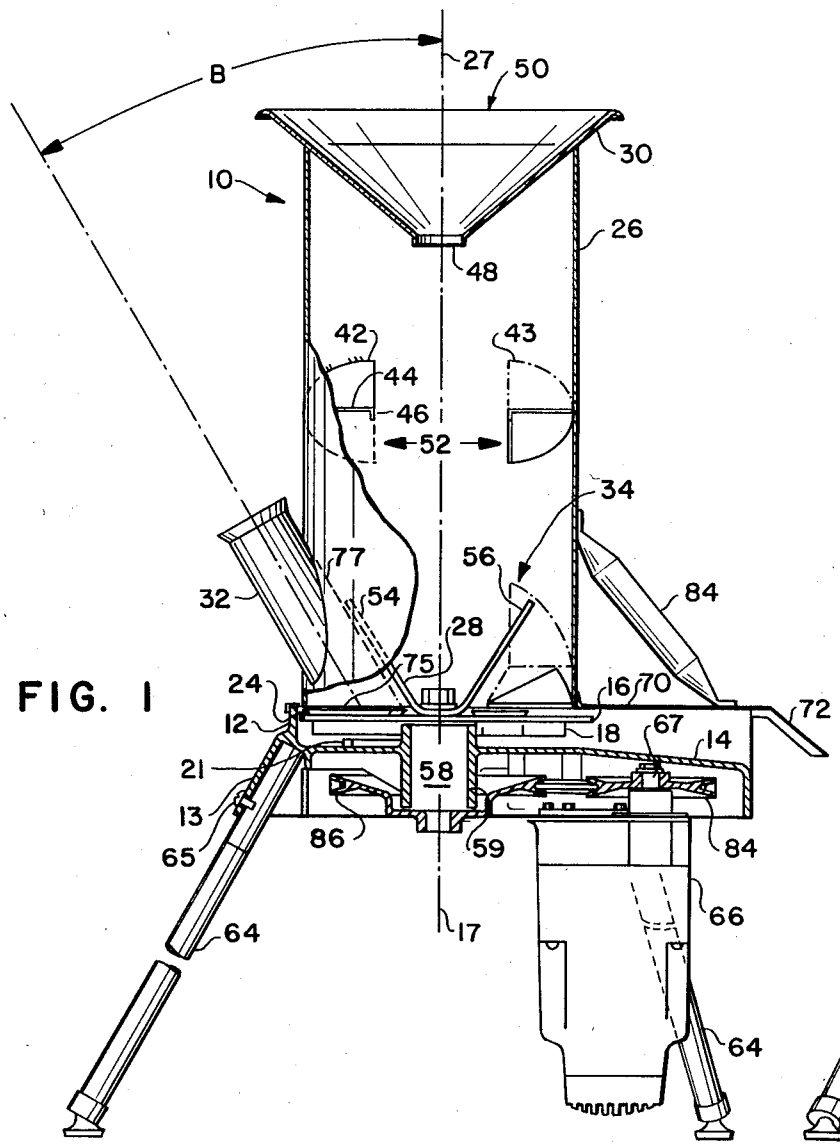
FIG. 1 is a side view of an apparatus according to the present invention in partial section and/or partial cut-away.
Figure 3:
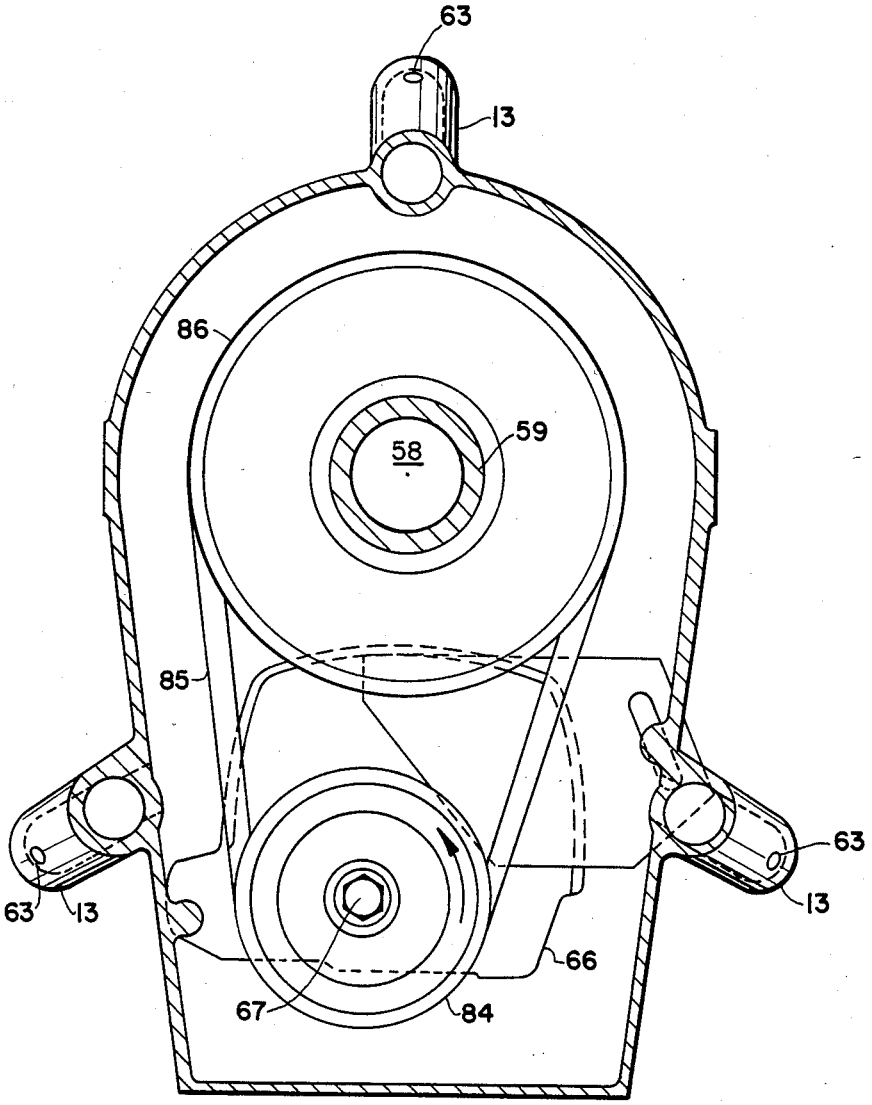
FIG. 3 is a section through the apparatus illustrated in FIGS. 1 and 2, along line A—A.

FIGS. 1 and 2 illustrate a machine for comminuting waste material, particularly garden wastes, according to the present invention. The machine, generally indicated at 10, comprises a cylindrical charging container 26 having a substantially vertical axis 27, provided with a funnel-like inlet 30 for light material and an inlet tube 32 for branches or heavier material. The cylindrical charging container is detachably connected to a cutter housing 12 having support legs 64. An electric motor 66 is mounted on the cutter housing 12 which motor serves to drive a rotatable shaft 58 having a cutter support plate 16 mounted thereon. The cutter support plate has a central substantially vertical axis 17 which is preferably coaxial with the axis 27 of the charging container 26.

Figure 5A:
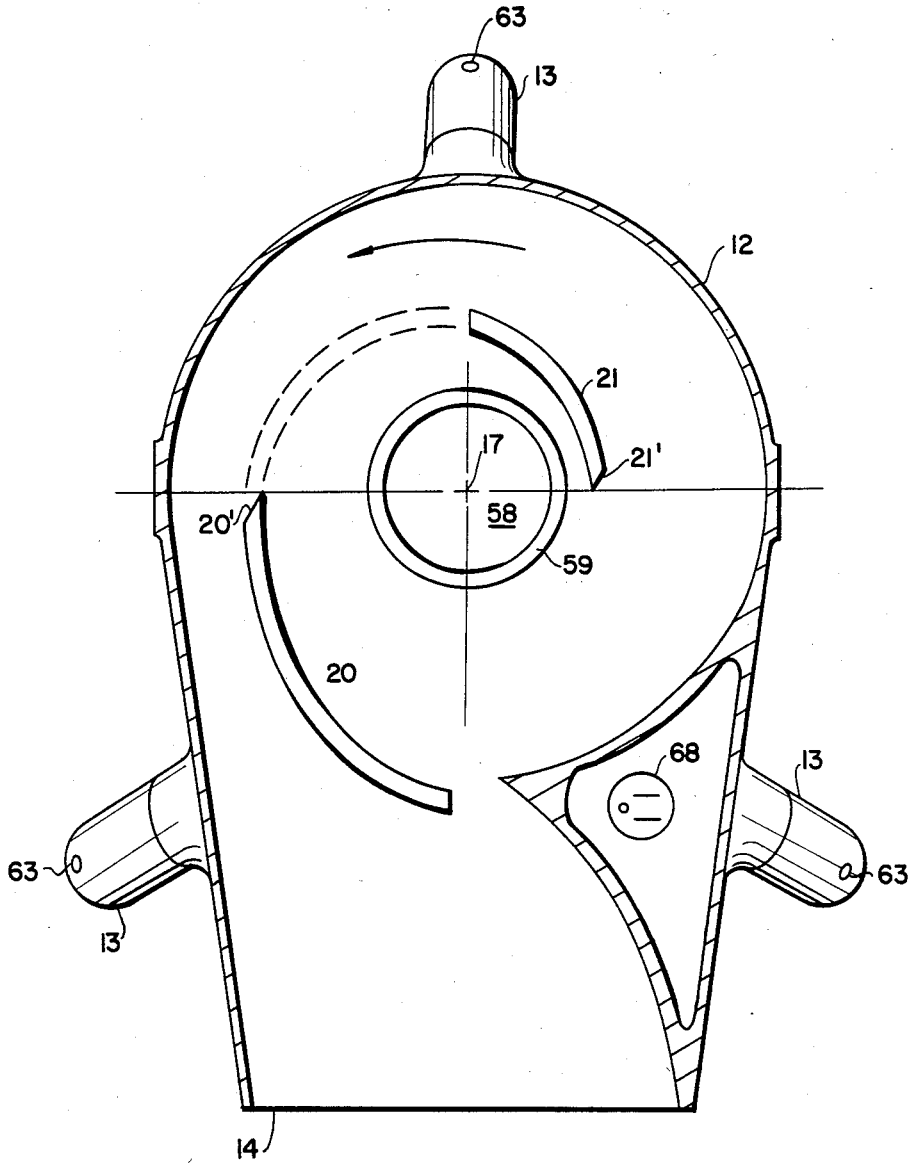
FIGS. 5A and 5B are top views of the cutter housing of the apparatus illustrated in FIGS. 1 and 2.

The cutter housing 12, shown in FIG. 5, is of generally U-shaped plan having a laterally-directed outlet 14 for the discharge of comminuted material from the machine. The laterally directed outlet 14 slopes downwardly as it extends from the cutter housing. The cutter housing has a journal bearing 59 for rotatably supporting cutter shaft 58. Leg pockets 13 are formed about the periphery of the cutter housing 12 for receipt of support legs 64 which are held in place by retaining screws 65 threaded through screw holes 63. Spiral deflecting vanes, 20 and 21, are mounted on the cutter housing 12 beneath the cutter support plate 16. These deflecting vanes, 20 and 21, are defined as two discrete sections of an imaginary spiral (shown by dotted lines in FIG. 5A) about the central vertical axis 17 of the cutter support plate. The vanes 20 and 21 are substantially diametrically opposed across the central vertical axis 17 of the cutter support plate 16.

Alternatively, the spiral deflecting vane can comprise the entire spiral (defined by sections 20,21 and the dotted line portion).

In both cases, the leading end of the spiral relative to the direction of rotation of the cutter support plate (dark arrow in FIG. 5A) is chamfered, 20' and 21', so as to be angled toward the periphery of the cutter housing and back from the direction of rotation of the cutter support plate. This chamfer prevents comminuted material from building up on the end of the deflecting vane.

Figure 5B:
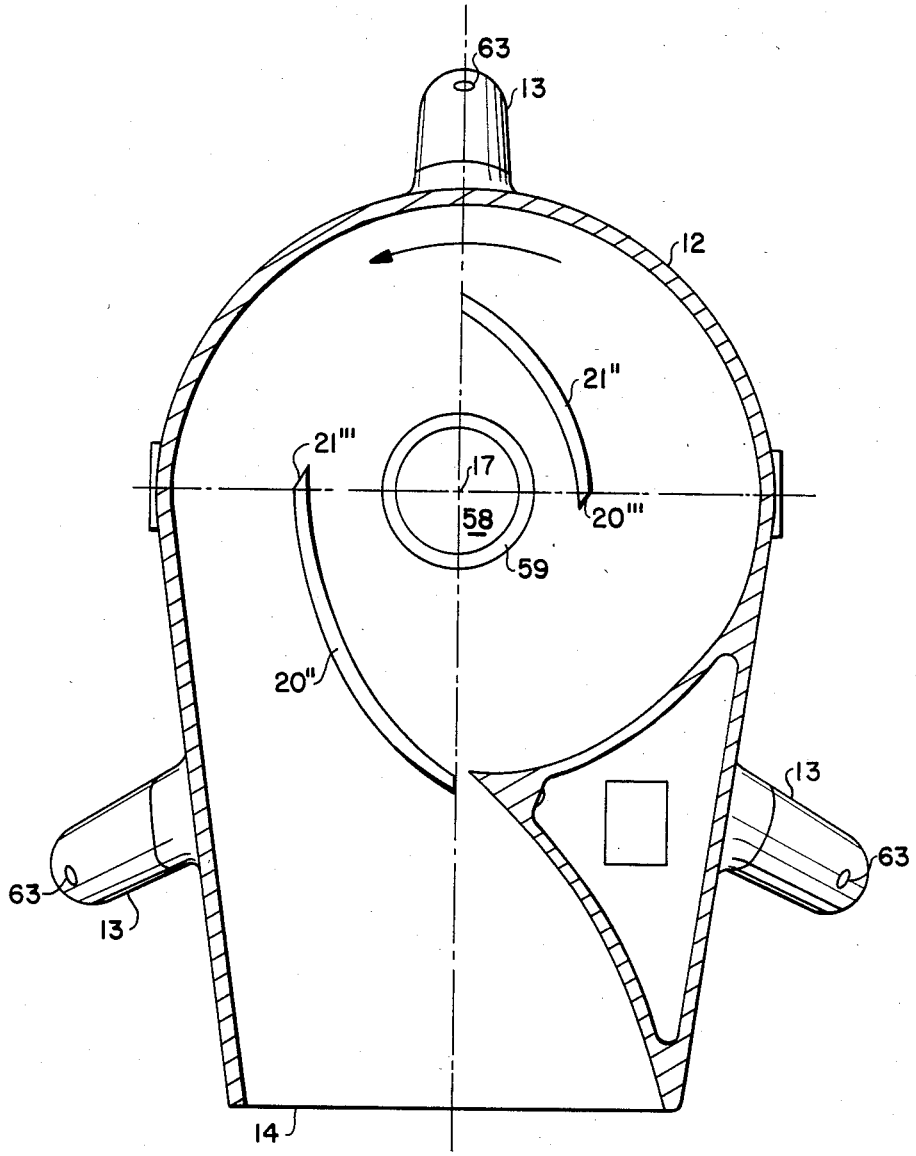

Preferably, as shown in FIG. 5B, two spiral deflecting vanes 20'' and 21'' are provided. Each vane being defined as a discrete section of a respective spiral. The leading edges of each of these spiral deflecting vanes are also chamfered °'''' and 21''', as described above.

Figure 6:
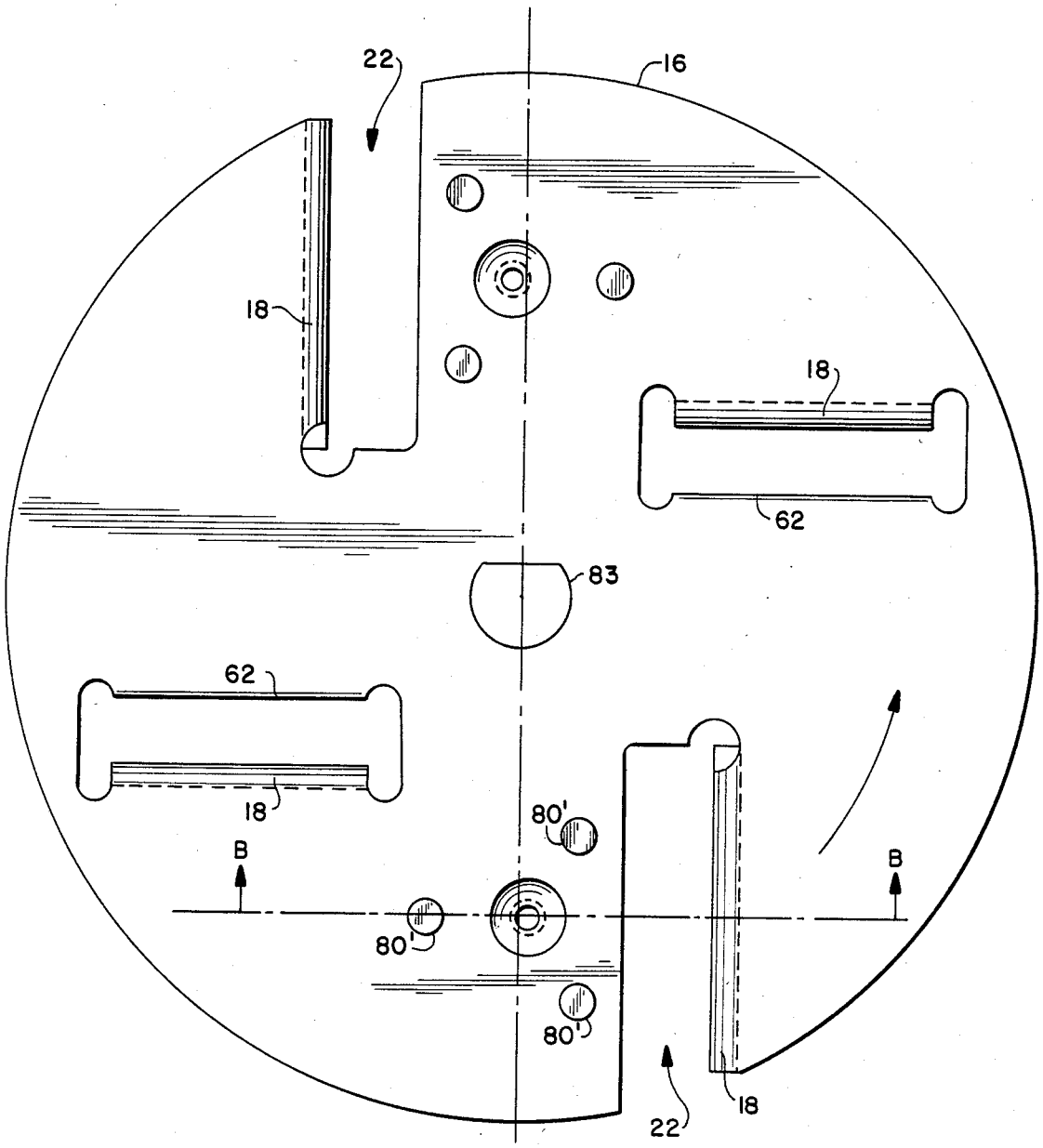
FIG. 6 is a top view of the cutter support plate of the apparatus illustrated in FIGS. 1 and 2.
Figure 7:
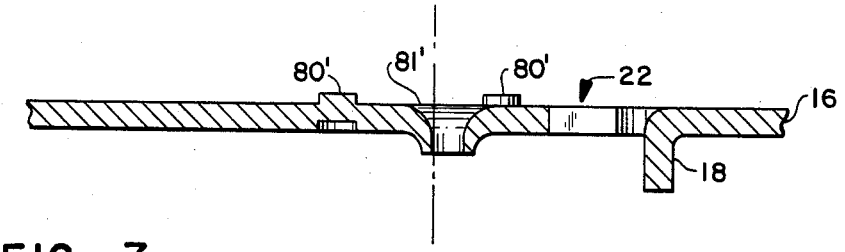
FIG. 7 is a section through the cutter support plate illustrated in FIG. 6, along line B—B.

The cutter support plate 16, shown in FIGS. 6 and 7, is mounted within the cutter housing 12 for rotation about a central substantially vertical axis 17. The cutter support plate has at least one dependent discharge blade 18 mounted on the lower side of the plate.

At least one non-radial cutting slot 22 is formed in the cutter support plate. Preferably, two such non-radial cutting slots are formed in the cutter support plate.

Non-radial passage slots 62 may also be formed in the cutter support plate. By non-radial, it is meant that the long axis of the slot does not coincide with a radius of the circle defining the cutter support plate 16. The dependent discharge blades 18 can be formed as a dependent lug by welding or bolting (neither shown) a lug on the lower side of the cutter support plate 16. Preferably, the dependent discharge blades 18 can be formed as a dependent lug from the stamping of the non-radial cutting slots 22 and/or non-radial passage slots in the cutter support plate 16. The lugs being formed at the leading edge of the slots relative to the direction of rotation of the cutter support plate (shown as a dark arrow in FIG. 6).

Figure 9:
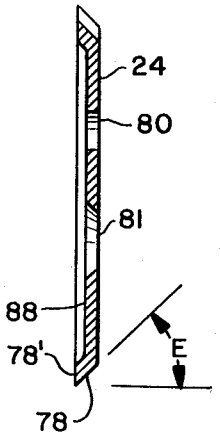
FIG. 9 is a section through the slicing cutter illustrated in FIG. 8, along line A—A.
Figure 8:
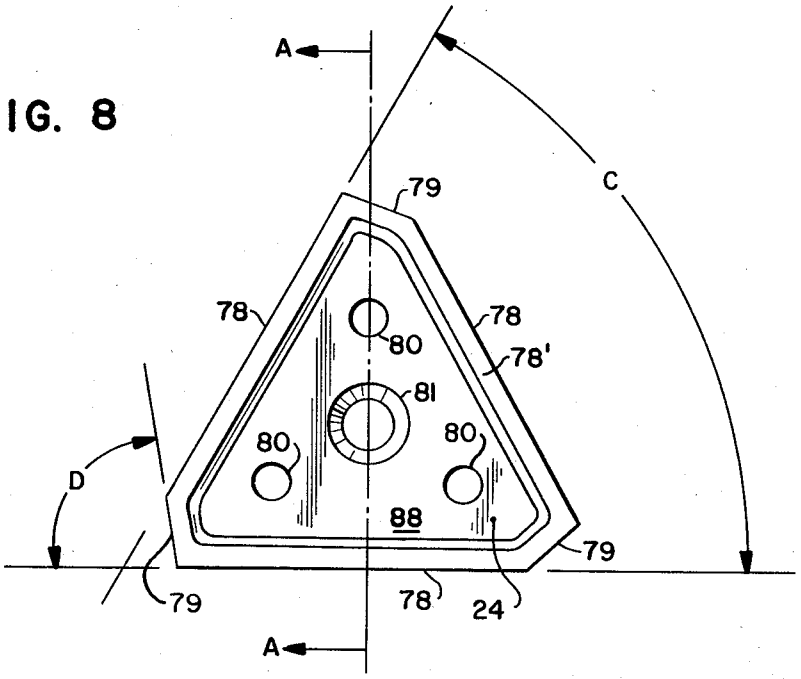
FIG. 8 is a top view of a slicing cutter of the apparatus illustrated in FIGS. 1 and 2.

A slicing cutter 24 (shown in FIGS. 8 and 9) is mounted above each non-radial cutting slot and cooperates therewith on rotation of the cutter support plate to slice waste material and direct the comminuted waste material through the cutter support plate 16. Additionally, the non-radial passage slots 62 allow additional area for passage of comminuted waste material through the cutter support plate 16.

Figure 10:
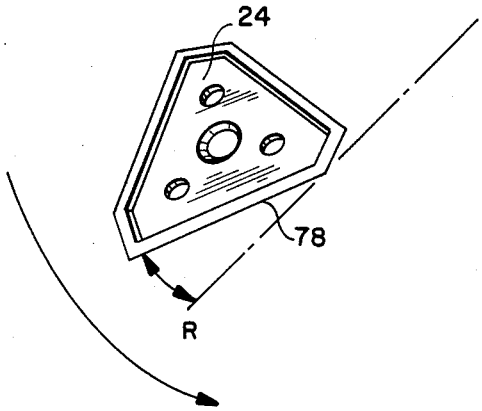
FIGS. 10 and 11 illustrate the action of slicing cutters encompassed by the present invention.

Preferably, the slicing cutter 24 is of generally triangular shape having three cutting edges 78. Most preferably, the slicing cutter is in the form of an equilateral triangle, i.e. angle C is 60°. In order to eliminate stress concentration at the apices of the triangle, the apices are cut back to form a solid edge 79, preferably angle D is 80°. Bore holes 80 and counter-sunk screw hole 81 are provided through the body of the slicing cutter. The bore holes 80 receive buttons 80' formed on the surface of the cutter support plate 16 and position the slicing cutter 24 thereon. A threaded screw hole 81' through the cutter support plate aligns with the counter-sunk screw hole 81 and receives a screw to fix the slicing cutter to the cutter support plate. If the cutting edge 78 which overlies the non-radial cutting slot 22 becomes blunt, the screw can be loosened, the blade rotated ⅓ turns and retightened. The cutting edge which effects the slicing of waste material, i.e. the edge overlying the non-radial cutting slot, inclines backwards from the direction of rotation of the cutter support plate (shown as a dark arrow in FIG. 4) from a radial line (shown as R in FIG. 4) passing through the "apex" of the triangle closest to the center of the cutter support plate and the center of the cutter support plate, in the direction from the center to the periphery of the cutter support plate (shown by the arrow head on radial line R in FIG. 4). By orienting the cutting edge in this manner, the edge provides effects a slicing cut of material brought into its path rather than a chopping action (experienced when blades are radially aligned). This is more clearly shown in FIG. 10, wherein a triangular shaped slicing cutter 24 is shown with its cutting edge 78 angled back from a radial line R of the cutter support plate (the direction of rotation of the cutter support plate being shown by the heavy arrow).

Additionally, the slicing cutter 24 is dischshaped, i.e. the cutting edge 78 extends above the plane of the main body 88 of slicing cutter 24. Thus, the upper surface 78' of cutting edge 78 lies above and parallel to the main body 88 of the cutter. This reduces friction during cutting, since heavy material entering through inclined inlet tube 32 will press down upon the slicing cutter 24. However, since only the upper surface 78' of the cutter will contact the material pressing down from above, and this surface is considerably smaller than the total surface of the cutter 24, the area for frictional resistance is greatly decreased.

Figure 11:
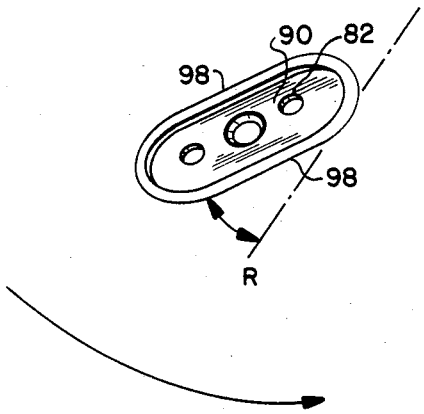

Alternatively, a dish-shaped oblong cutter having only two cutting edges can be utilized. Such a cutter 90 is shown in FIG. 11. Cutter 90 has two cutting edges 98 and is provided with bore hole 82 which function in the same manner as previously described to position the cutter on the cutter support plate and allow rotation of the cutter when one of the cutting edges 98 becomes blunt. Likewise, the cutting edge 98 is angled back from a radial line R of the cutter support plate (the direction of rotation of the cutter support plate being shown by the heavy arrow).

A cylindrical charging container 26 having a substantially vertical axis 27 is detachably mounted on the cutter housing 12, by draw latches 82, and positioned so that the cutter support plate 16 forms a base for the container. A discharge hood 70 extends laterally from the charging container, to cover laterally directed outlet 14, and terminates in a downwardly directed flap 72.

An inlet for light material 30 is located at the top of the charging container 26 and rigidly attached thereto. The inlet 30 is of a funnel-like shape tapering from a circular cross-section 50 at the top to a longitudinal slot 48 at the bottom.

An inlet for heavy material, such as large twigs and branches, comprising a downwardly inclined inlet tube 32 passing through a lower wall of the charging container 26 discharges above the cutter support plate 16 in the path of rotation of the slicing cutters 24. The inlet tube 32 is inclined at an angle B of less than 45° from the substantially vertical axis 27, preferably angle B is 30°. This steep angle results in the formation of chips which are rounder than the long oval chips formed by a shallow angle feed. Rounder chips, having a smaller cross-sectional area, resulting in a lower requirement in cutting power.

A fixed counter-plate 34 is located substantially diametrically opposite the inlet tube 32. This counter-plate comprises an upper section 36 sloping downwardly in the direction of rotation of the cutter support plate 16, a lower section 38 of substantially vertical orientation and a trailing or reinforcing section 40 sloping upwardly in the direction of rotation of the cutter support plate 16. The counter-plate 34 is positioned so that the path of rotation of each slicing cutter 24 is below and adjacent the counter-plate 34 and so that the path of rotation of shredding blades 54 and 56 is above and adjacent the counter-plate. The counter-plate 34 cooperates with the shredding blades 54 and 56 to produce shear action on waste material therebetween.

The shredding blades 54 and 56 are provided in the form of oppositely outwardly and upwardly inclined limbs of a U-shaped member 28. The central web 55 of the U-shaped member is located against the upper side of the cutter support plate 16 and secured together with the cutter support plate to the top of the cutter shaft 58 as by a hex nut 60. Conveniently, the cutter shaft 58, at its upper end, is D-shaped in cross-section so as to fit in a corresponding D-shaped bore 83 provided in the cutter support plate 16 so as to allow rotation of the cutter support plate without slippage. A similar D-shaped bore is provided in the central web 55 of U-shaped member 28 for the same purpose.

Upper deflecting vanes 42 and 43 are mounted on the interior of the wall of charging container 26, the deflector vanes 42 and 43 sloping downwardly in the direction of rotation of the cutter support plate 16 and being located above the path of rotation of the shredding blades 54 and 56. The deflecting vanes are each in the shape of a segment of an ellipse, the ellipse when viewed in plan defining a circle having the same diameter as the cylindrical charging container. The ellipse is defined by an imaginary plane intersecting the axis 27 of the cylindrical charging container at an angle A, generally 15°–40°, preferably 20°. The deflecting vanes 42 and 43 are of a substantially L-shaped cross-section having a long leg 44 and a short leg 46, the short leg 46 depending toward the cutter support plate 16. The deflecting vanes 42 and 43, located substantially diametrically opposite one another, are substantially congruent segments of an ellipse, and the gap between the two vanes, generally indicated at 52, is substantially parallel to the longitudinal slot 48 at the bottom of the funnel-like hopper 30.

An electric motor 66 is secured to the bottom of the cutter housing 12. The motor shaft 67 is secured to a belt pulley 84 which drives a V-belt 85 which in turn drives a large belt pulley 86. Belt pulley 86 is secured to cutter shaft 58 journaled in bearing 59 of the cutter housing 12. The cutter housing 12 is provided with a male electrical socket 68, electrically connected to the motor 66. The charging container is provided with a corresponding female electrical socket (not shown), electrically connected to a power supply cord (not shown). An electrical connection between the motor and the power supply cord is effected by engaging the male socket with the female socket when the charging container 26 is mounted on the cutter housing 12. Conversely, no electrical connection exists when the charging container is detached from the cutter housing thereby providing a safety feature during disassembly of the unit.

Alternatively, the cutter housing 12 is provided with a safety switch (not shown) which is electrically connected to the motor and the power supply cord. The charging container is provided with an actuating protrusion (not shown), which when in place actuates the safety switch to close the electrical connection between the power supply cord and the motor. However, as soon as the charging container is raised, the safety switch opens and interrupts the power supply to the motor.

Figure 4:
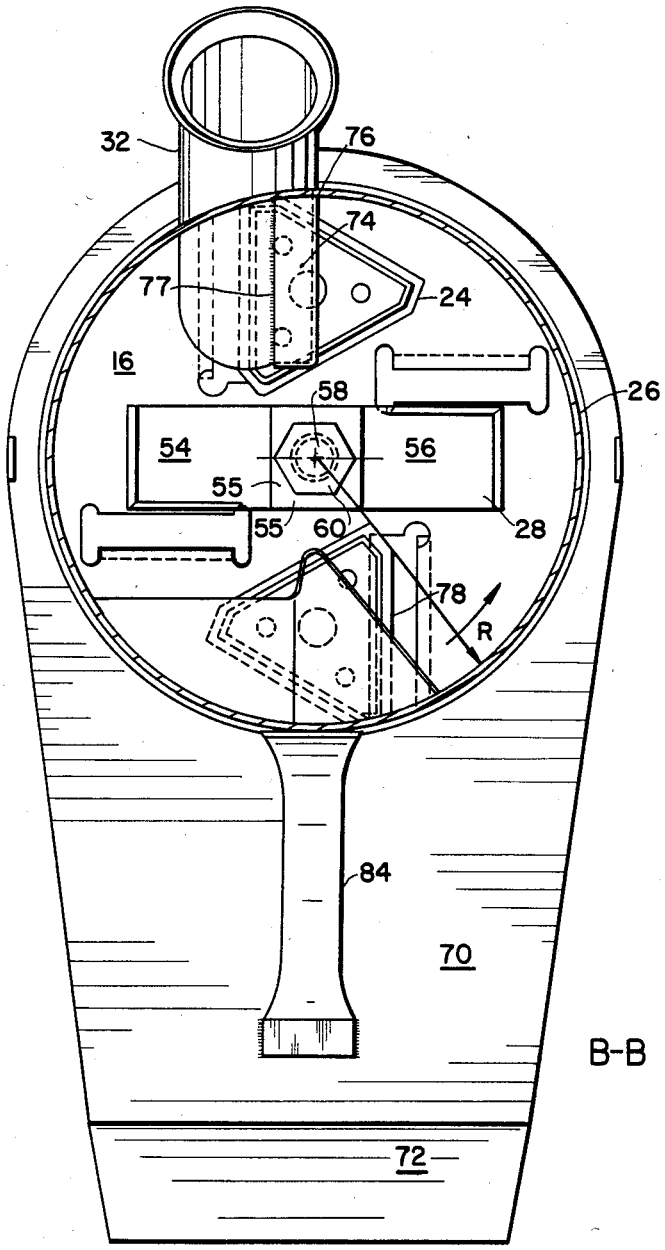
FIG. 4 is a section through the apparatus illustrated in FIGS. 1 and 2, along line B—B.

A triangular plate 74 is mounted on the inclined inlet tube 32, within the charging container 26, facing the direction of rotation of the cutter support plate (heavy arrow in FIG. 4). One side of the triangle 76 abutting the wall of the charging container 26, one side 77 following the profile of the inclined inlet tube and the remaining side 75 following the profile of the bottom of the inlet tube.

In operation, the cutter support plate 16 is rotated by motor 66 and light garden waste material is fed into charging container 26 through funnel-like inlet 30. As the material falls into the path of rotation of shredding blades 54 and 56, it is shredded thereby and subjected to shear action produced by the passage of blades 54 and 56 over counter-plate 34. Any material caught in the rotation of blades 54 and 56 is forced downwardly by upper deflecting vanes 42 and 43. Likewise, any material thrown upward by the blades is inhibited from flying out and directed downward by deflecting vanes 42 and 43. Triangular plate 74 mounted on inlet tube 32 prevents material from becoming wedged between the inlet tube 32 and the wall of charging container 26 and acting as a drag brake on the rotating cutter support plate 16. In addition to cooperating with blades 54 and 56 to produce a shear action on waste material, counter-plate 34 guides material caught up in the rotation of blades 54 and 56 downwards by inclined section 36 toward the cutter support plate 16. However, substantially vertical section 38 prevents the material from being forced onto the cutter support plate 16 and clogging the rotation of the plate. Reinforcing section 40 acts to withstand the rotary motion of the waste material without requiring heavy gauge materials for construction. Slicing cutters 24 further comminute any waste materials and direct it through the non-radial cutting slots 22 to the dependent discharge blades 18 mounted beneath the cutter support plate 16. Comminuted material also passes through non-radial passage slots 62 to the dependent discharge blades 18 located beneath the cutter support plate 16.

Heavy material, such as large twigs and limbs, is fed through inclined inlet tube 32 directly into the path of slicing cutters 24 and sliced into rounded chips by the cutters and directed downwardly through the non-radial cutting slots 22.

Beneath the cutter support plate, spiral deflecting vanes 20 and 21 cooperate with the dependent discharge blades 18 to prevent material from being caught up in the rotary motion of the discharge blades and to force comminuted material out of the machine through laterally-directed discharge 14. Discharge hood 70 contains the material within the discharge outlet 14 and flap 72 deflects the material, which is exiting with considerable force, in a downward direction.

Brace 84 gives rigidity to the assembly of the charging container 26 and discharge hood 70, and may be used as a handle for carrying the apparatus.

What is claimed is:

1. A machine for comminuting material comprising:

a cutter housing having a laterally-directed outlet for the discharge from the machine of comminuted material;

a cutter support plate mounted within the cutter housing for rotation about a central substantially vertical axis, said cutter support plate provided with at least one dependent discharge blade located on the lower side of said plate;

at least one spiral deflecting vane means mounted on the cutter housing beneath said cutter support plate for cooperating with said at least one dependent discharge blade upon rotation of the cutter support plate to force comminuted waste through the laterally-directed outlet;

at least one non-radial cutting slot in the cutter support plate, a slicing cutter mounted upon the cutter support plate above each non-radial cutting slot and cooperating therewith on rotation of the cutter support plate to slice waste material and direct the comminuted waste material downwardly through the cutter support plate;

a charging container having a substantially vertical axis and walls for receiving waste material to be comminuted located over the cutter housing, the cutter support plate being positioned so as to form a base for the container;

at least one shredding blade mounted on the upper side of the cutter support plate for rotation therewith and extending upwardly and outwardly from said central substantially vertical axis into the charging container;

an inlet for light material to be comminuted located at the top of the container;

an inlet for heavy material to be comminuted comprising a downwardly inclined inlet tube passing through a lower wall of the container to discharge above the cutter support plate in the path of rotation of said at least one slicing cutter; and a fixed counter-plate means located substantially diametrically opposite said inlet for heavy material, comprising an upper section sloping downwardly in the direction of rotation of said cutter plate and a lower section of substantially vertical orientation, said counter-plate means positioned so that the path of rotation of each slicing cutter is below and adjacent said counter-plate and so that the path of rotation of each shredding blade is above and adjacent said counter-plate, said counter-plate means cooperating with each shredding blade to produce shear action on waste material therebetween.

2. The machine as claimed in claim 1, wherein two spiral deflecting vanes are mounted on said cutter housing beneath said cutter support plate.

3. The machine as claimed in claim 2, wherein said two spiral deflecting vanes are defined by two discrete sections of an imaginary continuous spiral about the central vertical axis of the cutter support plate.

4. The machine as claimed in claim 2, wherein said two discrete sections are substantially diametrically opposed across the central vertical axis of the cutter support plate.

5. The machine as claimed in claim 2, wherein the leading ends of said spiral deflecting vanes, relative to the direction of rotation of the cutter support plate, are chamfered so as to be angled toward the periphery of the cutter housing and back from the direction of rotation of the cutter support plate.

6. The machine as claimed in claim 2, wherein said two spiral deflecting vanes are each defined by a discrete section of a respective spiral about the central vertical axis of the cutter support plate.

7. The machine as claimed in claim 6, wherein the leading ends of said spiral deflecting vanes, relative to the direction of rotation of the cutter support plate, are chamfered so as to be angled toward the periphery of the cutter housing and back from the direction of rotation of the cutter support plate.

8. The machine as claimed in claim 6, said two spiral deflecting vanes are substantially diametrically opposed across the central vertical axis of the cutter support plate.

9. The machine as claimed in claim 1, wherein said spiral deflecting vane is defined by a section of a continuous spiral about the central vertical axis of the cutter support plate.

10. The machine as claimed in claim 9, wherein the leading end of said spiral deflecting vane, relative to the direction of the cutter support plate, is chamfered so as to be angled toward the periphery of the cutter housing and back from the direction of rotation of the cutter support plate.

11. The machine as claimed in claim 1, wherein two shredding blades are provided in the form of oppositely outwardly and upwardly inclined limbs of a U-shaped member rotatable adjacent the fixed counter-plate.

12. The machine as claimed in claim 11, wherein a cutter shaft mounted for rotation about said central substantially vertical axis is drivingly coupled to the motor and the central web of the U-shaped member is located against the upper side of the cutter support plate and is secured together with the cutter support plate to the top of the cutter shaft.

13. The machine as claimed in claim 1, wherein the charging container is located on and detachably connected to the cutter housing.

14. The machine as claimed in claim 1, wherein said charging container is cylindrical and the substantially vertical axis of the charging container and is coaxial with the central substantially vertical axis of the cutter support plate.

15. The machine as claimed in claim 1, further comprising at least one non-radial passage slot means for passing comminuted waste material downwardly through the cutter support plate.

16. The machine as claimed in claim 15, wherein said at least one dependent discharge blade comprises a dependent lug formed by stamping said at least one non-radial passage slot in the cutter support plate, said lugs being formed at the leading edge of said slots relative to the direction of rotation of said cutter support plate.

17. The machine as claimed in claim 1, further comprising legs supporting the cutter housing and a motor means, mounted on the cutter housing, for rotatably driving the cutter support plate.

18. The machine as claimed in claim 17, wherein the motor means is an electric motor, the cutter housing is provided with a male electrical socket, electrically connected to said motor, the charging container is provided with a corresponding female electrical socket, electrically connected to an electric power supply cord, and electrical connection between said power supply cord and said motor is effected by engaging said male socket with said female socket.

19. The machine as claimed in claim 17, wherein the motor means is an electric motor, the cutter housing is provided with an electrical switch, electrically connected to said motor and to an electrical power supply cord, said electrical switch being normally open; the charging container is provided with an activating protuberance, such that when said activating protuberance is brought into contact with said switch, said switch closes completing the electrical connection between said motor and said power supply cord.

20. The machine as claimed in claim 1, wherein the cutter housing is of U-shape in plan, the charging container is located on and detachably connected to the cutter housing at the closed end of the U, a laterally-directed discharge hood is provided over the discharge channel extending from the cutter housing as the open end of the U, a downwardly-inclined flap is provided on the hood at the outlet end of the discharge channel, and said discharge channel slopes downward as it extends from the cutter housing.

21. The machine as claimed in claim 1, wherein said at least one dependent discharge blade comprises a dependent lug formed by stamping said at least one non-radial cutting slot in the cutter support plate, said lug being formed at the leading edge of said slot relative to the direction of rotation of said cutter support plate.

22. The machine as claimed in claim 1, wherein a triangular plate is mounted on the inclined inlet tube, facing the direction of rotation of the cutter support plate, one side of said triangular plate abutting the wall of the charging container.

23. The machine as claimed in claim 1, wherein the slicing cutter comprises a dish-shaped substantially triangularly triple-edged cutter plate detachably mounted over its associated non-radial cutting slot, one of the cutting edges of the cutter being positioned to effect the slicing of waste material.

24. The machine as claimed in claim 23, wherein the cutting edge positioned for effecting the slicing of waste material inclines backwards relative to the direction of rotation of the cutter support plate from a radial line, passing through the apex of the triangle closest to the center of the cutter support plate and the center of the cutter support plate, in the direction from the center to the periphery of the cutter support plate.

25. In a garden waste comminuting apparatus comprising a cutter housing having a laterally-directed discharge outlet; a cutter support plate mounted within the cutter housing for unidirectional rotation about a central vertical axis; at least one dependent discharge blade located on the lower side of said plate; at least one slot in the cutter support plate with a cutting blade mounted thereabove; a cylindrical charging container located over the cutter housing, the cutter support plate forming a base for the container; at least one shredding blade mounted centrally on the upper side of the cutter support plate and extending upwardly and outwardly therefrom into the charging container, an inlet for light material at the top of the container, an inlet for heavy material discharging above the cutter support plate; at least one fixed counter-plate located above the path of rotation of said cutting blade and below the path of rotation of said shredding blade; the improvement comprising at least one spiral deflecting vane means mounted on the cutter housing beneath said cutter support plate for cooperation with said at least one dependent discharge blade to force comminuted waste into the laterally-directed outlet upon rotation of the cutter support plate.

26. A shredder-mulcher for comminuting garden waste material comprising:

first blade means for slicing heavy material into comminuted form;

second blade means for shredding light material into comminuted form;

means for rotating said first blade means and said second blade means about a central substantially vertical axis, the path of rotation of said first blade means lying in a plane perpendicular to said central substantially vertical axis and the path of rotation of said second blade means lying above that of the first blade means and extending upwardly and outwardly from said central vertical axis;

first deflecting means for deflecting waste material in a downward direction, located between the paths of rotation of said first blade means and said second blade means, said first deflecting means cooperating with said second blade means to produce a shearing action therewith;

a first inlet means for feeding heavy material into the path of rotation of said first blade means;

a second inlet means for feeding light material into the path of rotation of said second blade means from above;

discharge means for imparting kinetic energy to comminuted material, said discharge means located beneath the path of rotation of said first blade means;

second deflection means for preventing comminuted material from clogging said discharge means and cooperating with said discharge means to force comminuted material in a direction orthogonal to said central vertical axis; and third deflection means for deflecting waste material in a downward direction, located between said second inlet and the path of rotation of said second blade means.

* * * * *